US008719966B2

(12) United States Patent
Grozdev

(10) Patent No.: US 8,719,966 B2
(45) Date of Patent: May 13, 2014

(54) GARMENT WITH COMPARTMENTS

(76) Inventor: Dmitriy Grozdev, Tacoma, WA (US)

( * ) Notice: Subject to any disclaimer, the term of this patent is extended or adjusted under 35 U.S.C. 154(b) by 260 days.

(21) Appl. No.: 13/354,289

(22) Filed: Jan. 19, 2012

(65) Prior Publication Data

US 2013/0185840 A1 Jul. 25, 2013

(51) Int. Cl.
*A41D 13/06* (2006.01)

(52) U.S. Cl.
USPC ..... 2/247; 2/79

(58) Field of Classification Search
USPC ..... 2/247, 227, 23, 94, 253, 79
See application file for complete search history.

(56) References Cited

U.S. PATENT DOCUMENTS

| | | | | | |
|---|---|---|---|---|---|
| 683,029 | A * | 9/1901 | Estes | 2/251 |
| 1,645,502 | A * | 10/1927 | Sweet | 2/227 |
| 2,042,282 | A * | 5/1936 | Tworoger | 2/247 |
| 2,078,461 | A * | 4/1937 | Siegel | 2/93 |
| 2,230,258 | A * | 2/1941 | Miller | 2/247 |
| 2,495,582 | A * | 1/1950 | Henderson | 2/94 |
| 2,593,218 | A * | 4/1952 | Swain | 2/48 |
| 2,628,452 | A * | 2/1953 | Gladstein | 446/28 |
| 2,663,876 | A * | 12/1953 | Miller et al. | 2/227 |
| 3,130,416 | A * | 4/1964 | Mitchell et al. | 2/79 |
| 4,613,991 | A * | 9/1986 | Grover | 2/23 |
| 5,210,881 | A * | 5/1993 | Stocker et al. | 2/247 |
| 5,394,565 | A * | 3/1995 | Stewart et al. | 2/69 |
| 5,398,345 | A * | 3/1995 | Kenneth et al. | 2/247 |
| 5,509,147 | A * | 4/1996 | Busquets | 2/253 |
| 5,634,215 | A * | 6/1997 | DeBaene | 2/227 |
| 5,884,338 | A * | 3/1999 | Golde | 2/247 |
| 6,769,139 | B1 * | 8/2004 | Goldkind | 2/247 |
| 6,978,484 | B2 * | 12/2005 | Donlan et al. | 2/227 |
| 7,003,810 | B2 * | 2/2006 | Goldkind | 2/227 |
| 7,058,987 | B2 * | 6/2006 | Salazar | 2/247 |
| D572,434 | S * | 7/2008 | Yeates et al. | D2/742 |
| D580,629 | S * | 11/2008 | Adams et al. | D2/742 |
| D586,085 | S * | 2/2009 | Lounsbury, Jr. | D2/742 |
| 7,908,675 | B2 * | 3/2011 | Robinson | 2/247 |
| 8,316,469 | B2 * | 11/2012 | Miller | 2/227 |
| 2004/0187183 | A1 * | 9/2004 | Hautala | 2/24 |
| 2004/0237178 | A1 * | 12/2004 | Landeros | 2/457 |
| 2005/0120464 | A1 * | 6/2005 | Clark | 2/247 |
| 2005/0229292 | A1 * | 10/2005 | Watkins et al. | 2/227 |
| 2007/0028349 | A1 * | 2/2007 | Watson | 2/69 |
| 2008/0216212 | A1 * | 9/2008 | Burgess et al. | 2/228 |
| 2009/0282600 | A1 * | 11/2009 | Robinson | 2/79 |
| 2011/0072556 | A1 * | 3/2011 | Bang | 2/227 |
| 2012/0030861 | A1 * | 2/2012 | Miller | 2/221 |
| 2012/0117705 | A1 * | 5/2012 | Hawkins et al. | 2/23 |
| 2012/0117713 | A1 * | 5/2012 | Hoffner | 2/227 |
| 2013/0019374 | A1 * | 1/2013 | Schwartz | 2/69 |

* cited by examiner

*Primary Examiner* — Richale Quinn
(74) *Attorney, Agent, or Firm* — Puget Patent; Michael Gibbons

(57) ABSTRACT

A garment having compartments for holding objects. Some compartments are operable to permit waste to pass out of the compartments. Others are attached to the garment on the thigh or other location to permit access where a standard hip pocket would be blocked by a toolbelt. Others have apertures in addition to the normal hip pocket opening which may permit access to the pocket where the opening to the hip pocket would be blocked by a toolbelt. The garment may be used by a worker, such as a carpenter, with knee pads in compartments in a knee area of the garment, the compartments having apertures operable to permit sawdust and other waste to empty from the compartment. Additionally, a thigh pocket may have a cover preventing waste from entering the pocket, and can provide storage where a hip pocket would be blocked by a toolbelt or rendered inaccessible by kneeling.

11 Claims, 9 Drawing Sheets

GARMENT WITH COMPARTMENTS

FIELD OF THE INVENTION

This invention relates generally to garments, and more specifically, to a garment with compartments.

SUMMARY

This invention relates generally to garments, and more specifically, to a garment with compartments. In some embodiments, a garment may be a pair of pants, the pair of pants having a compartment at the knee area of the pair of pants, a thigh pocket at the thigh area of the pair of pants, and a hip pocket at the hip area of the pair of pants.

In some embodiments, the compartment at the knee area of the pair of pants may be operable to hold a kneepad. In some embodiments, the compartment at the knee area of the pair of pants may have one or more apertures disposed along one or more edges or corners of the compartment. In some embodiments, the one or more apertures may be operable to permit waste to pass from the compartment.

In some embodiments, a thigh pocket at the thigh area of the pair of pants may have a flap covering the opening to the thigh pocket, the flap operable to reduce waste that might otherwise enter the thigh pocket. In some embodiments, the thigh pocket may have an aperture operable to permit waste to pass from the thigh pocket.

In some embodiments, a hip pocket at the hip area of the pair of pants may have an aperture in the hip pocket, the aperture in the hip pocket being longer than the opening of the hip pocket, the aperture in the hip pocket running in a substantially perpendicular orientation to the opening of the hip pocket, running along the leg instead of transversely across the leg. In some embodiments, an aperture in a hip pocket may be closed with a zipper or other fastener.

BRIEF DESCRIPTION OF THE DRAWINGS

Embodiments of the present invention are described in detail below with reference to the following drawings.

DETAILED DESCRIPTION

This invention relates generally to garments, and more specifically, to a garment with compartments. Specific details of certain embodiments of the invention are set forth in the following description, FIGS. 1-11 and in the APPENDIX to provide a thorough understanding of such embodiments. The present invention may have additional embodiments, may be practiced without one or more of the details described for any particular described embodiment, or may have any detail described for one particular embodiment practiced with any other detail described for another embodiment.

Figure 1:
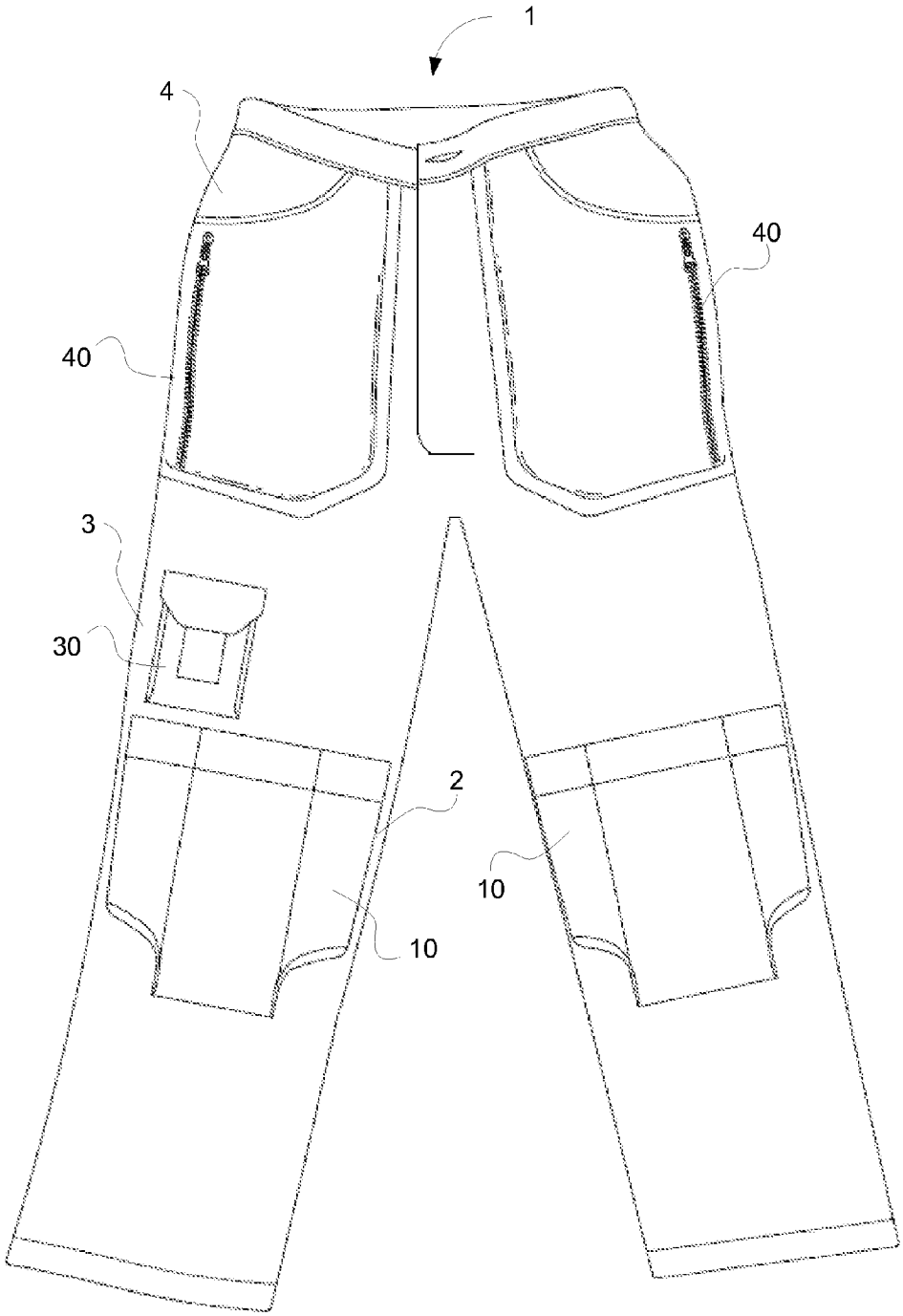
FIG. 1 is a front view of a garment with compartments, in accordance with an embodiment of the invention.

FIG. 1 is a front view of a garment with compartments, in accordance with an embodiment of the invention. In some embodiments, a garment with compartments may be a pair of pants. In different embodiments, a garment with compartments may be another type of garment. For example, in some embodiments, a garment with compartments may be a shirt, a jacket, or overalls. Those with skill in the art will understand that the compartments disclosed herein have functionality useful for more than just a pair of pants. The present disclosure uses a pair of pants as an exemplary, non-limiting embodiment only.

In some embodiments, a garment with compartments 1 in the exemplary embodiment of a pair of pants may include a knee area of the pants 2, a thigh area of the pants 3, and a hip area of the pants 4. In some applications, it may be advantageous for the knee area of the pants 2 to have padding. Consequently, in the exemplary embodiment, the knee area of the pants 2 may have a compartment 10, the compartment 10 operable to accommodate a knee pad.

In some applications, it may be advantageous for the thigh area of the pants 3 to have a pocket, for example, for availability of storage when a tool belt is worn which blocks access to the top opening of hip pockets, or when the wearer is kneeling, restricting access to the opening of a hip pocket. Consequently, in the exemplary embodiment, the thigh area of the pants 3 may have a thigh pocket 30. A thigh area may be defined as an area approximately at a midpoint below the waist and above the knee. However, upon familiarization with this disclosure, it will be realized by those with skill in the art that a thigh pocket may be disposed other than at the thigh. For example, a thigh pocket may be disposed along the arm of a jacket, for example at a location between the bicep and tricep. A thigh pocket may be disposed on a pair of pants on the rear of the pants. Many locations for a thigh pocket as defined herein exist and all are within the grasp of those with skill in the art.

In some applications, it may be advantageous for the hip area of the pants 4 to have a hip pocket with a zipper, for example, for access to the hip pocket when a tool belt is worn which blocks access to the top opening of a hip pocket, or for insertion into the hip pocket of an object larger than the opening of the hip pocket, or when the wearer is kneeling, restricting access to the opening of the hip pocket. Consequently, in the exemplary embodiment, the hip area of the pants 4 may have a hip pocket 40 with a zipper. A hip area may be defined as an area approximately below the waist and to the side. However, upon familiarization with this disclosure, it will be realized by those with skill in the art that a hip pocket may be disposed other than at the hip. For example, a hip pocket may be disposed along the arm of a jacket, for example at a location between the bicep and tricep. A hip pocket as defined herein may be disposed on a pair of pants on the rear of the pants. Many locations for a hip pocket as defined herein exist and all are within the grasp of those with skill in the art.

Figure 2:
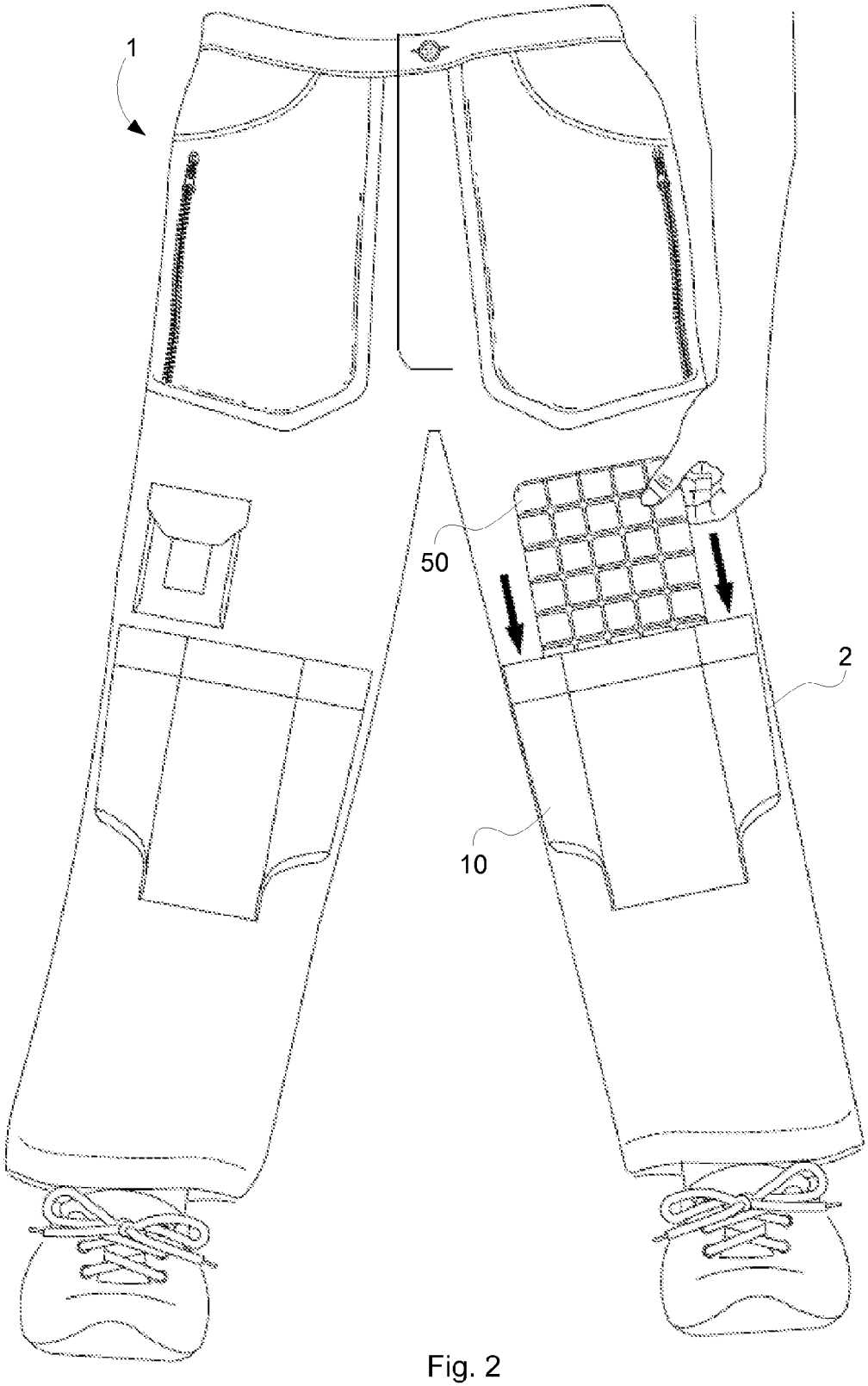
FIG. 2 is a front view of a garment with compartments, in accordance with an embodiment of the invention.

FIG. 2 is a front view of a garment with compartments, in accordance with an embodiment of the invention. In some embodiments, a garment with compartments 1 may have a compartment 10 over the knee area 2, the compartment 10 operable to accommodate a knee pad 50, for example. Those with skill in the art will understand that a compartment 10 at the knee area 2 of the garment with compartments 1 may accommodate other objects, such as a differently shaped knee pad than depicted in FIG. 2.

Figure 3A:
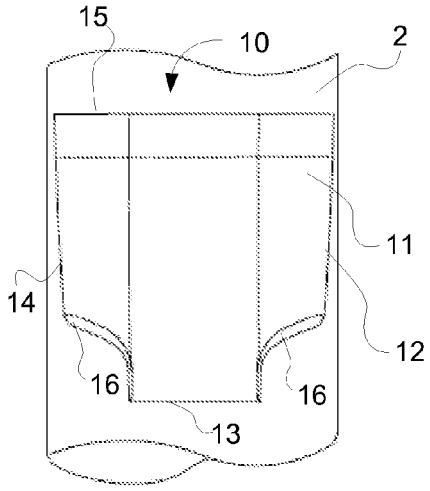
FIGS. 3*a*, 3*b* and 3*d* are front views
Figure 3B:
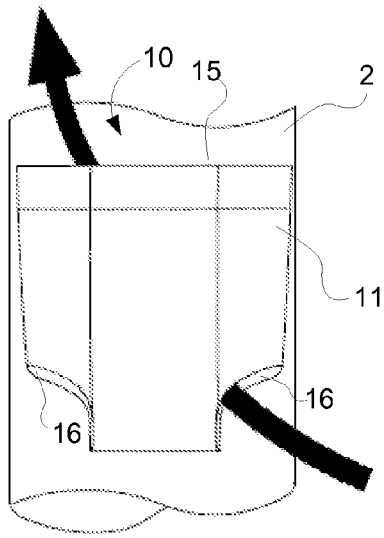
Figure 3C:
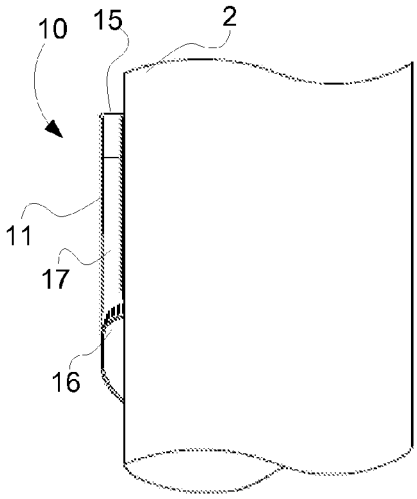
FIG. 3*c* is a side view of a garment with compartments, in accordance with an embodiment of the invention.
Figure 3D:
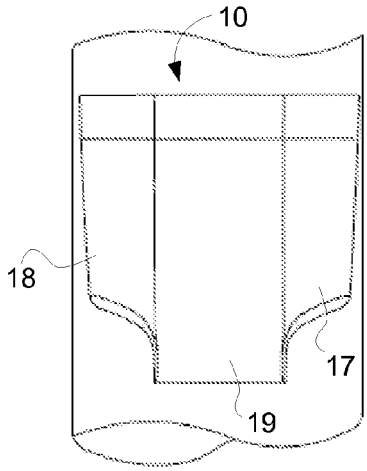

FIGS. 3*a*, 3*b* and 3*d* are front views of a garment with compartments, in accordance with an embodiment of the invention. FIG. 3*c* is a side view of a garment with compartments, in accordance with an embodiment of the invention. In some embodiments, a compartment 10 is attached to the pair of pants at the knee area of the pants 2. In some embodiments, a compartment 10 is comprised of a front panel 11, the front panel 11 attached to the garment at least along one or more edges of the front panel 11 to define a compartment 10, with an interior of the compartment 10 disposed between the front panel 11 and the garment.

In some embodiments, a front panel 11 may be attached at the knee area of the pants 2 to form the compartment 10, the front panel 11 being attached along at least a portion of one or more edges of the front panel 11. For example, the front panel 11 may have portions of the right edge 12 of the front panel 11, the bottom edge 13 of the front panel 11, and the left edge 14 of the front panel 11 all attached to the garment. In a particular embodiment, at least a portion of the top edge of the front panel 11 is not attached to the garment, defining an opening 15 configured for access to the interior of the compartment 10. That is, one can slide a hand or an object through the opening 15 to have access to the interior of the pocket, the interior defined by the front panel 11 being attached to the garment along the three edges as described above, the interior of the compartment being disposed between the front panel 11 and the garment. Particularly, access to the compartment 10 through the opening 15 that is disposed along the top of the compartment 10 ensures objects such as a knee pad 50 do not fall out of the compartment 10 when the wearer of the garment is standing or kneeling.

In some embodiments, a compartment 10 has a bellows construction permitting the compartment 10 to expand. For example, the front panel 11 may be constructed in sections, where the sections comprise a right bellow 17, a left bellow 18, and a center section 19. The bellows 17 and 18 and center section 19 may have a substantially perpendicular alignment to the opening 15 of the compartment 10. The bellows 17 and 18 may slightly overlap the center section 19, permitting the compartment 10 to expand when an object is inserted into the compartment 10 as the front panel 11 bows out from the garment.

In a particular embodiment, a compartment 10 has at least one aperture 16 configured for permitting waste to empty from the compartment 10. In some embodiments, the at least one aperture 16 of the compartment 10 is defined by at least a portion of one or more edges of the front panel 11 that are not attached to the garment. For example, an aperture 16 disposed in the lower right corner of the compartment 10 may be defined by portions of the right edge 12 of the front panel 11 and the bottom edge 13 of the front panel 11, the portions of the edges not being attached to the garment. In some embodiments, there may be a corresponding cutout of the front panel 11, reducing the size of the front panel 11, the cutout further defining the aperture 16. The aperture 16 may, for example, be operable to permit waste such as sawdust to empty from the compartment 10. In some embodiments, a compartment 10 may have an aperture 16 at each bottom corner of the compartment 10. In different embodiments, a compartment 10 may have one or more apertures 16 disposed in the bottom edge 13 of the compartment 10. In other embodiments, a compartment 10 may have apertures 16 disposed along any edge of the compartment 10. In different embodiments, a compartment 10 may have apertures 16 disposed in the front panel 11 away from the edges of the front panel 11.

Figure 4A:
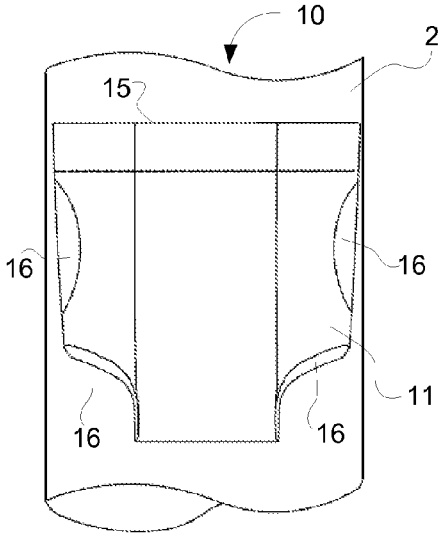
FIGS. 4*a* and 4*b* are a front view and a side view of a garment with compartments, in accordance with an embodiment of the invention.
Figure 4B:
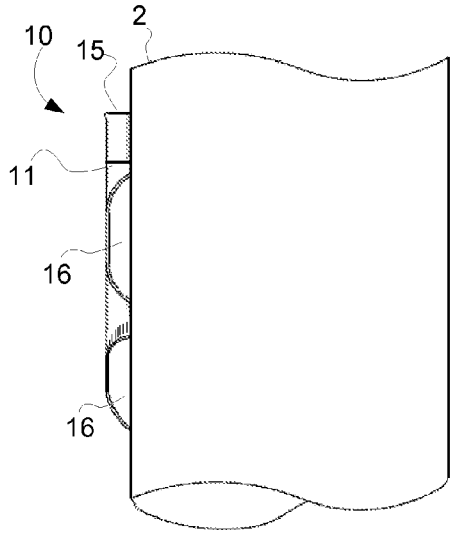

FIGS. 4*a* and 4*b* are a front view and a side view of a garment with compartments, in accordance with an embodiment of the invention. In some embodiments, a compartment 10 attached to a garment with compartments 1 at a knee area of the garment 2 may have a third aperture 16 and a fourth aperture 16, the third and fourth apertures 16 disposed along the left and right sides of the compartment 10.

Figure 5A:
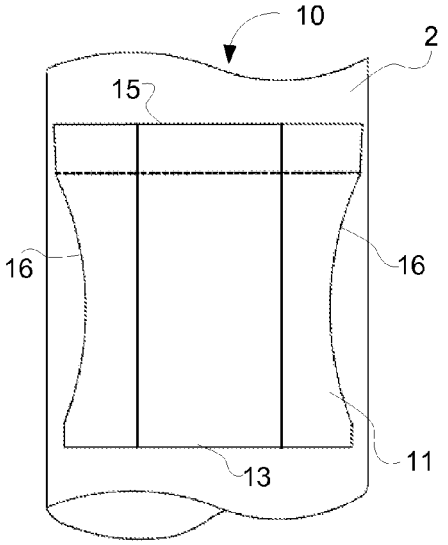
FIGS. 5*a* and 5*b* are a front view and a side view of a garment with compartments, in accordance with an embodiment of the invention.
Figure 5B:
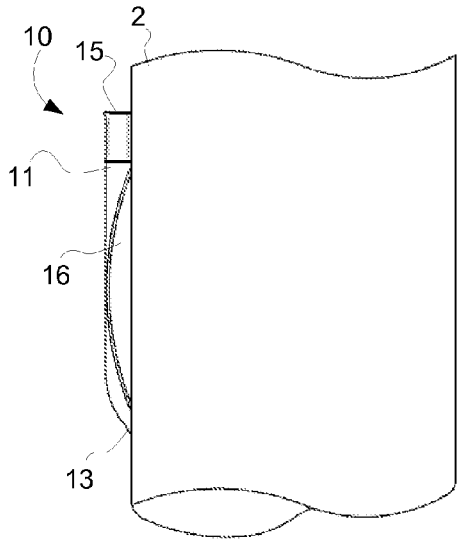

FIGS. 5*a* and 5*b* are a front view and a side view of a garment with compartments, in accordance with an embodiment of the invention. In some embodiments, a compartment 10 attached to a garment with compartments 1 at a knee area of the garment 2 may have a first aperture 16 and a second aperture 16, the first and second apertures 16 disposed along the left and right sides of the compartment 10. Particularly, in this embodiment, no apertures are disposed along the bottom side 13 of the front panel 11. That is, the bottom side 13 of the front panel 11 is fully attached to the garment.

Figure 6A:
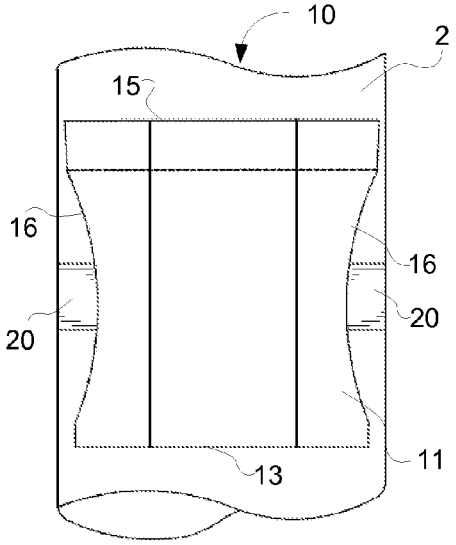
FIGS. 6*a* and 6*b* are a front view and a side view of a garment with compartments, in accordance with an embodiment of the invention.
Figure 6B:
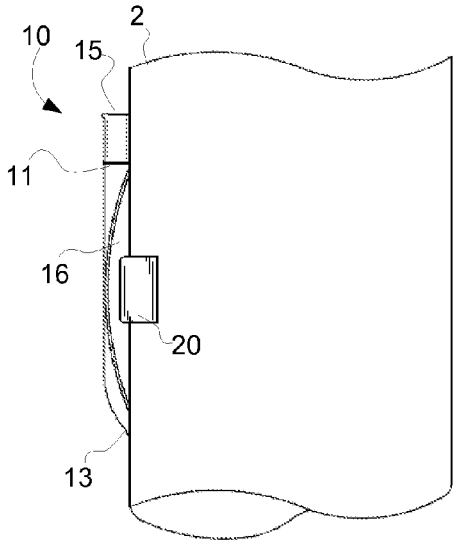

FIGS. 6*a* and 6*b* are a front view and a side view of a garment with compartments, in accordance with an embodiment of the invention. In some embodiments, a compartment 10 attached to a garment with compartments 1 at a knee area of the garment 2 may have a first aperture 16 and a second aperture 16, the first and second apertures 16 disposed along the left and right sides of the compartment 10. Particularly, in this embodiment, no apertures are disposed along the bottom side 13 of the front panel 11. That is, the bottom side 13 of the front panel 11 is fully attached to the garment. In some embodiments, a garment may have an elastic band 20 attached to the garment, the attachment points disposed outside the front panel 11, with the elastic band running through the interior of the compartment 10 through at least two apertures 16. The elastic band 20 may, for example, be operable to secure a pad inserted into the compartment 10. In some embodiments, the elastic band 20 has attachment points attaching the elastic band 20 to the garment inside the interior of the compartment 10, such that no portion of the elastic band extends outside the compartment 10.

Figure 7A:
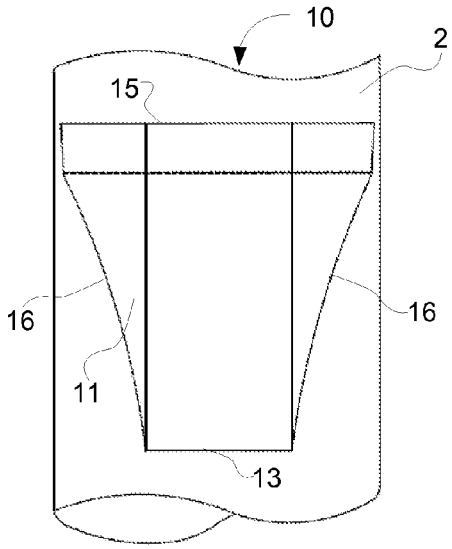
FIGS. 7*a* and 7*b* are a front view and a side view of a garment with compartments, in accordance with an embodiment of the invention.
Figure 7B:
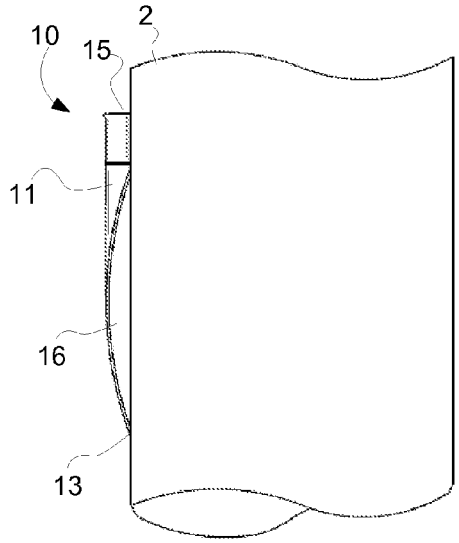

FIGS. 7*a* and 7*b* are a front view and a side view of a garment with compartments, in accordance with an embodiment of the invention. In some embodiments, a compartment 10 attached to a garment with compartments 1 at a knee area of the garment 2 may have a first aperture 16 and a second aperture 16, the first and second apertures 16 disposed at the left and right bottom corners of the compartment 10. Particularly, in this embodiment, the size of the apertures 16 is expanded, the apertures 16 being defined by a significant portion of the left and right sides of the front panel 11 being cut away.

Figure 8A:
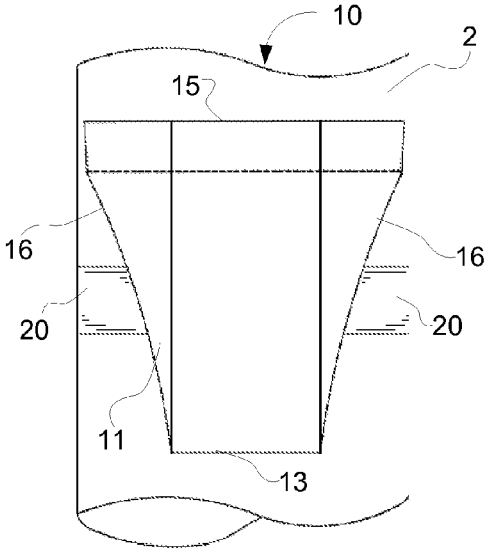
FIGS. 8*a* and 8*b* are a front view and a side view of a garment with compartments, in accordance with an embodiment of the invention.
Figure 8B:
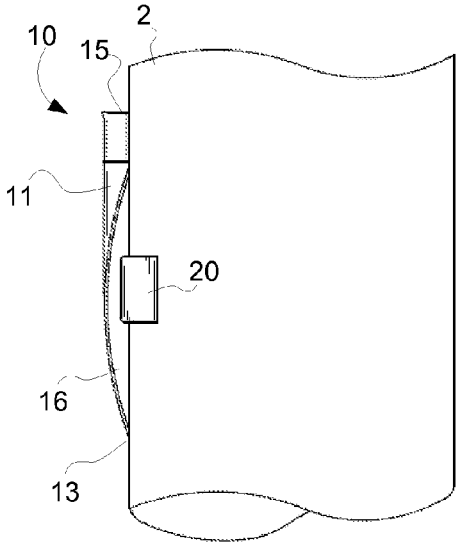

FIGS. 8*a* and 8*b* are a front view and a side view of a garment with compartments, in accordance with an embodiment of the invention. The compartment 10 of FIGS. 7*a* and 7*b* is partially depicted. Particularly, in this embodiment, a garment may have an elastic band 20 attached to the garment, the attachment points disposed outside the front panel 11, with the elastic band running through the interior of the compartment 10 through at least two apertures 16. The elastic band 20 may, for example, be operable to secure a pad inserted into the compartment 10. In some embodiments, the elastic band 20 has attachment points attaching the elastic band 20 to the garment inside the interior of the compartment 10, such that no portion of the elastic band extends outside the compartment 10.

Figure 9A:
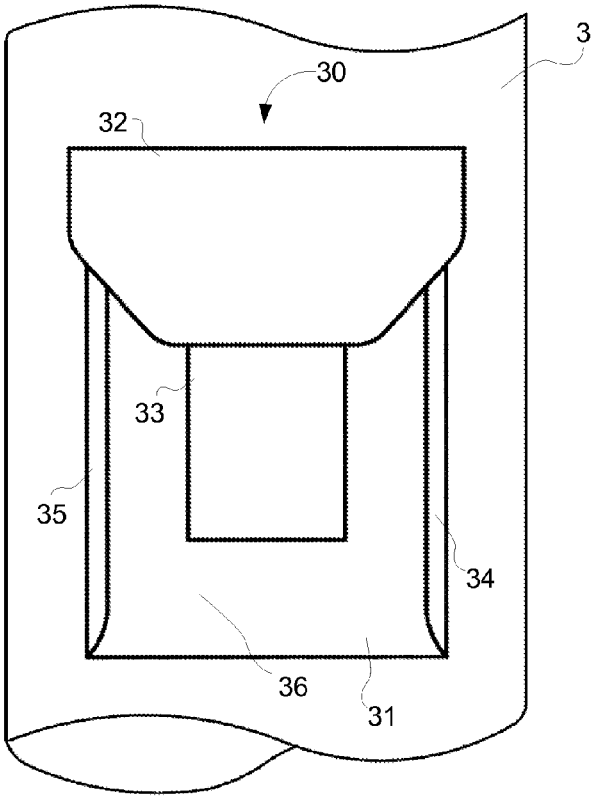
FIGS. 9*a* and 9*c* are front views and FIG. 9*b* is a side view of a garment with compartments, in accordance with an embodiment of the invention.
Figure 9B:
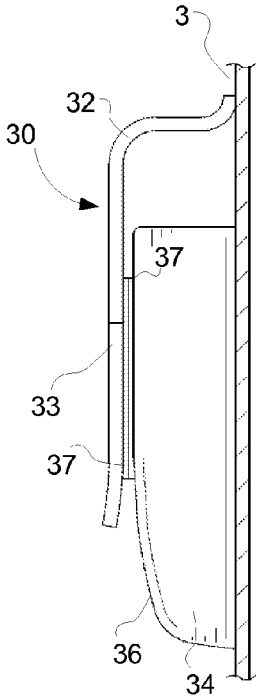
Figure 9C:
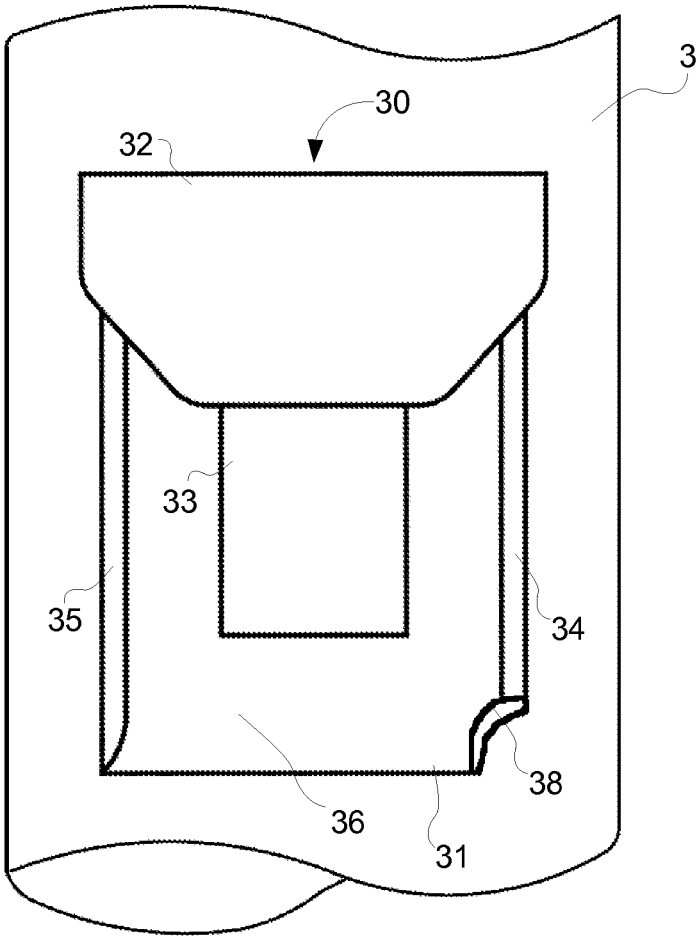

FIGS. 9*a* and 9*c* are front views and FIG. 9*b* is a side view of a garment with compartments, in accordance with various embodiments of the invention. In some embodiments, a thigh pocket 30 is attached to the garment at the thigh area of the pants 3. In some embodiments, a thigh pocket 30 is comprised of a front panel 31, the front panel 31 attached to the garment at least along one or more edges of the front panel 31 to define the thigh pocket 30, with an interior of the thigh pocket 30 disposed between the front panel 31 and the garment.

In some embodiments, a thigh pocket 30 has a bellows construction permitting the thigh pocket 30 to expand. For example, the front panel 31 may be constructed in sections, where the sections comprise a right bellow 34, a left bellow 35, and a center section 36. The bellows 34 and 35 and the center section 36 may have a substantially perpendicular alignment to the opening of the thigh pocket 30. The bellows 34 and 35 may slightly overlap the center section 36, permitting the thigh pocket 30 to expand when an object is inserted into the thigh pocket 30 as the front panel 31 bows out from the garment.

In some embodiments, a thigh pocket 30 has a flap 32 that covers the opening of the thigh pocket 30. A flap 32 may have a tab 33 that is disposed immediately below the flap 32, the tab 33 in some embodiments being narrower than the flap 32, the tab 33 permitting the flap 32 to be opened and closed over the opening at the top of the thigh pocket 30. In some embodiments, a fastener 37 is used to securably fasten the tab 33 to the front panel 31 of the thigh pocket 30. In some embodiments, the fastener 37 may be a hook-and-loop fastener, wherein a hook portion of the hook-and-loop fastener may be disposed on an inside portion of the tab 33, and a loop portion of the hook-and-loop fastener may be disposed on an outside portion of the front panel 31. In some embodiments, the loop portion of the hook-and-loop fastener may be disposed on the center section 36 of the front panel 31. Other fasteners may be used as a fastener 37. For example, a fastener 37 may be a snap, a button, a zipper, or other such fastener. A flap 32 and tab 33 may be operable to cover the opening to the thigh pocket 30, for example, to prevent waste from accumulating within the interior of the thigh pocket 30.

In some embodiments, a thigh pocket 30 may have one or more apertures 38, the apertures 38 operable to permit waste to empty from the interior of the thigh pocket 30. Construction of the apertures 38 of the thigh pocket 30 is similar to the construction of the apertures 16 as disclosed with regards to FIGS. 3-8.

Figure 10:
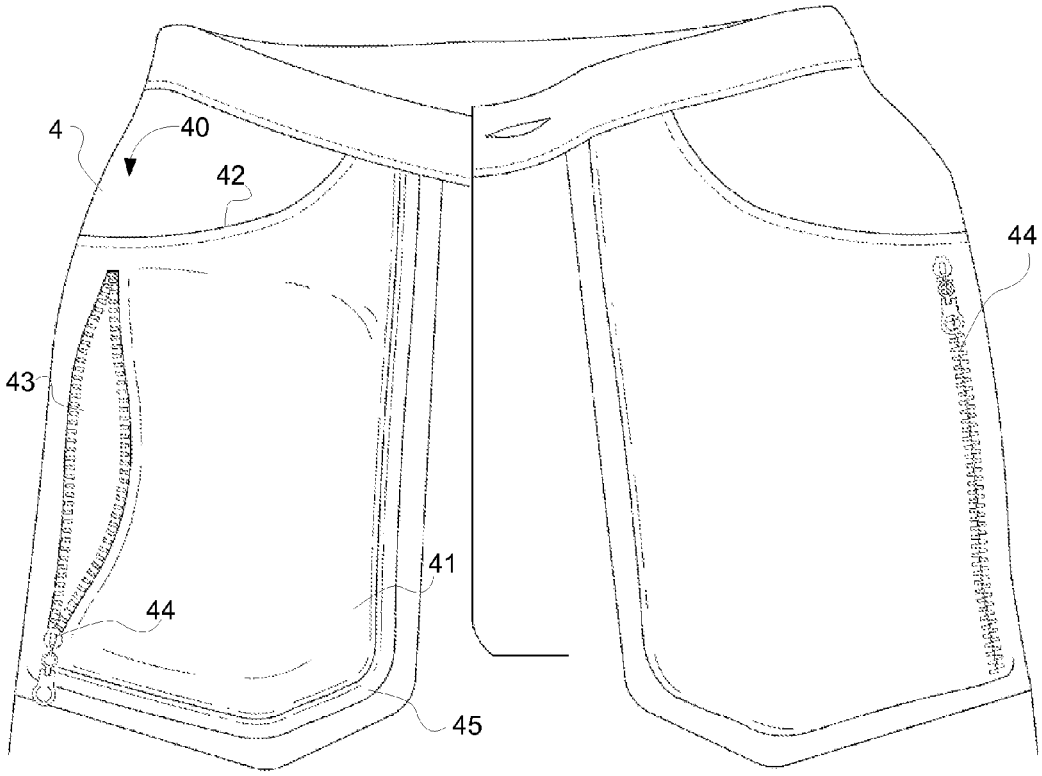
FIG. 10 is a front view of a garment with compartments, in accordance with an embodiment of the invention.
Figure 11:
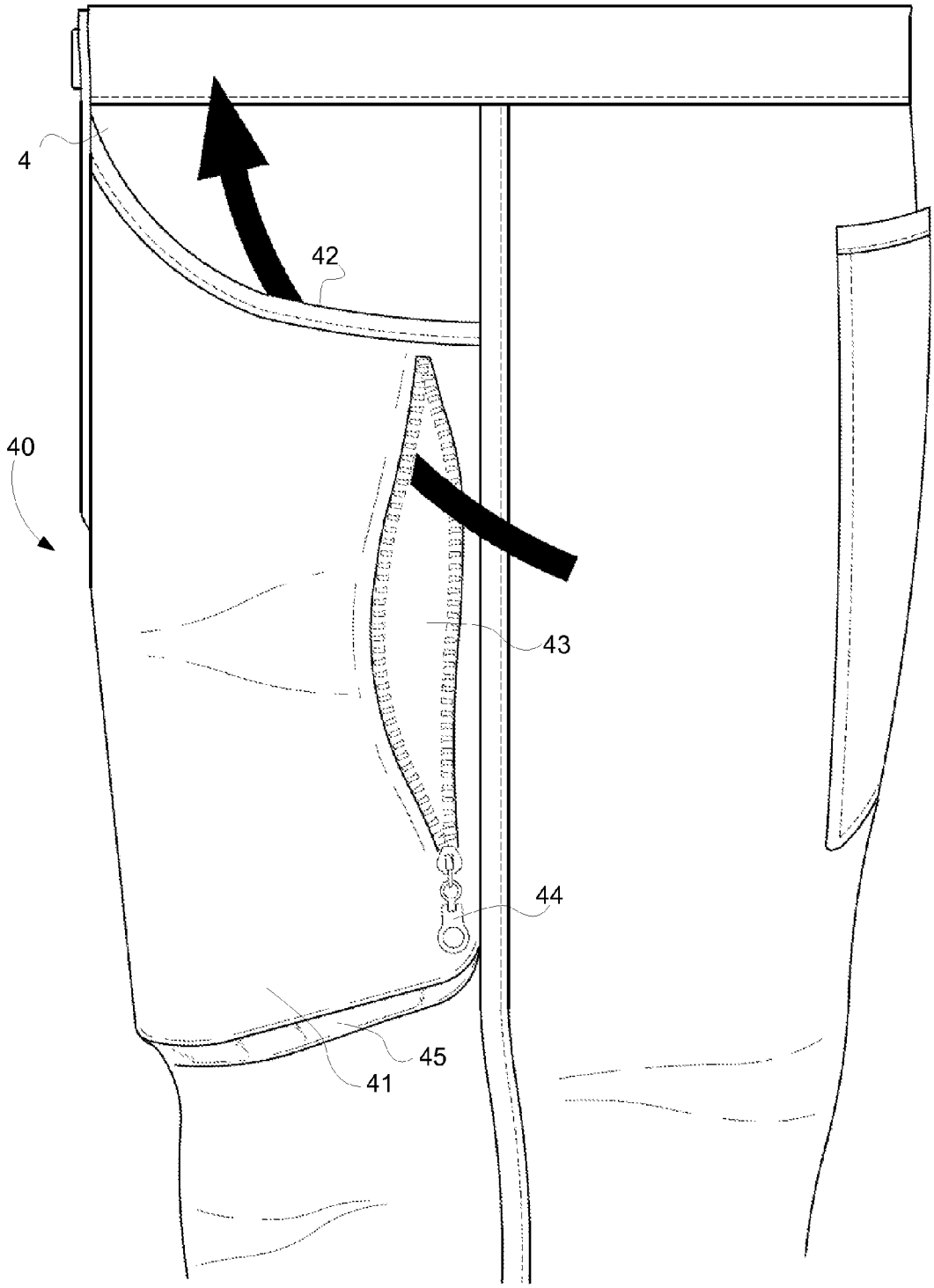
FIG. 11 is a side view of a garment with compartments, in accordance with an embodiment of the invention.

FIGS. 10 and 11 are a front view and a side view of a garment with compartments, in accordance with an embodiment of the invention. In some embodiments, a thigh pocket 40 is attached to a thigh area 4 of the garment. In some embodiments, a thigh pocket 40 is comprised of a front panel 41, the front panel 41 attached to the garment at least along one or more edges of the front panel 41 to define a thigh pocket 40, with an interior of the thigh pocket 40 disposed between the front panel 41 and the garment. In some embodiments, a thigh pocket 40 is not attached to the garment along a top edge of the front panel 41 defining an opening 42, the opening 42 operable to permit access to the interior of the thigh pocket 40.

In some embodiments, a thigh pocket 40 has a bellows construction permitting the thigh pocket 40 to expand. For example, the front panel 41 may be constructed in sections, where the sections comprise at least a first bellow 45 coupled with the front panel 41. The bellow 45 may slightly overlap the front panel 41, permitting the thigh pocket 40 to expand when an object is inserted into the thigh pocket 40, as the front panel 41 bows out from the garment.

In some embodiments, a front panel 41 of a thigh pocket 40 has an aperture 43, the aperture 43 configured for providing additional access to the interior of the pocket. The aperture 43 may have a length that is longer than the opening 42. In some embodiments, the aperture 43 may be substantially perpendicular to the opening 42, running along the leg rather than transversely across the leg. In some embodiments, the aperture 43 may be closed with a fastener. In some embodiments, the fastener is a zipper 44, the zipper 44 operable to close the aperture 43 of the front panel 41. In different embodiments, a fastener may be a snap, a button, a hook-and-loop fastener, or other such fastener.

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A pair of pants, comprising:

one or more compartments configured for emptying waste, including at least:

a front panel attached to the pants at least along one or more edges of the front panel to define a compartment with an interior of the compartment disposed between the front panel and the pants;

at least a portion of an edge of the front panel that is not attached to the pants, the at least a portion of an edge defining an opening configured for access to the interior of the compartment at a top of the compartment, wherein the front panel is attached to the pants to form two bellows of the front panel and a center section of the front panel, wherein the center section of the front panel is disposed between the two bellows of the front panel, wherein the two bellows enable the front panel to expand, and wherein the bellows and center section of the front panel have a substantially perpendicular alignment to the opening configured for access to the interior of the compartment;

at least two corner apertures of the compartment configured for permitting waste to empty from the compartment, the at least two corner apertures defined by at least a portion of one or more edges of the front panel that is not attached to the pants, wherein a first aperture is at a first bottom corner of the compartment and a second aperture is at a second bottom corner of the compartment; and at least two side apertures of the compartment configured for permitting waste to empty from the compartment, wherein a first side aperture is along a first side of the compartment, and a second side aperture is along a second side of the compartment.

2. The garment of claim 1, wherein an elastic band is attached to the pair of pants, the elastic band running through the interior of the compartment, the elastic band operable to secure a pad inserted into the compartment.

3. The garment of claim 1, further comprising:

one or more pockets attached to the exterior of the pair of pants approximately at a midpoint below the waist and above the knee, the pocket further comprising a front panel attached to the pair of pants to define the pocket with at least a portion of the front panel that is not attached to the pair of pants defining an opening of the pocket.

4. The garment of claim 3, wherein the one or more pockets attached to the pair of pants at a midpoint below the waist and above the knee are configured for emptying waste.

5. The garment of claim 3, wherein the one or more pockets attached to the pair of pants at a midpoint below the waist and above the knee have at least one aperture of the pocket configured for permitting waste to empty from the compartment.

6. The garment of claim 3, wherein the one or more pockets attached to the pair of pants at a midpoint below the waist and above the knee have a flap that covers the pocket and a fastener operable to close the flap over the pocket.

7. The garment of claim 3, wherein the one or more pockets attached to the pants at a midpoint below the waist and above the knee have a front panel, the front attached to the garment to form two bellows of the front panel and a center section of the front panel, wherein the center section of the front panel is disposed between the two bellows of the front panel, wherein the two bellows enable the front panel to expand, and wherein the center section of the front panel has a substantially perpendicular alignment to the opening configured for access to the interior of the pocket.

8. The garment of claim 3, wherein the one or more pockets attached to the pants at a midpoint below the waist and above the knee have at least one aperture of the pocket configured for permitting waste to empty from the pocket, the at least one aperture of the pocket configured for permitting waste to empty from the pocket defined by at least a portion of one or more edges of the front panel that is not attached to the pair of pants.

9. The garment of claim 1, further comprising:

one or more pockets having a zipper, the one or more pockets having a zipper further comprising:

a front panel attached to the garment at least along one or more edges of the front panel to define a pocket with an interior of the pocket disposed between the front panel and the garment;

at least a portion of an edge of the front panel that is not attached to the garment, the at least a portion of an edge defining an opening configured for access to the interior of the pocket;

an aperture of the front panel, the aperture of the front panel configured for access to the interior of the pocket; and a zipper operable to close the aperture of the front panel.

10. The garment of claim 9, wherein the aperture of the front panel having a zipper operable to close the aperture of the front panel is longer than the opening configured for access to the interior of the pocket.

11. The garment of claim 3, wherein the pocket has at least a first bellow disposed between the front panel and the garment, wherein the bellow enables the front panel to expand.

* * * * *